United States Patent [19]

Savage

[11] 4,082,204

[45] Apr. 4, 1978

[54] CONTAINER-DISPENSER FOR DESICCANT MATERIAL FOR INCLUSION IN A RACKET HANDLE

[76] Inventor: Marc Savage, 6 Horizon Rd., Fort Lee, N.J. 07024

[21] Appl. No.: 736,390

[22] Filed: Oct. 28, 1976

[51] Int. Cl.[2] ..... B65D 47/20

[52] U.S. Cl. ..... 222/191; 222/485; 222/516

[58] Field of Search ..... 222/191, 516, 548, 555, 222/565, 480, 485, 196.1–196.3; 273/75, 73; 401/200, 265, 266

[56] References Cited

U.S. PATENT DOCUMENTS 1,404,883 1/1922 Murray ..... 222/516

*Primary Examiner*—Robert B. Reeves
*Assistant Examiner*—John P. Shannon
*Attorney, Agent, or Firm*—Hopgood, Calimafde, Kalil, Blaustein & Lieberman

[57] ABSTRACT

A container-dispenser adapted to be contained in the end of a racket handle for holding and dispensing, when desired, a supply of a desiccant material such as rosin. The open end of the container is normally closed by a two-piece closure which can be operated by the application of pressure by the palm of the player's hand to release the material onto the player's hands. Upon the release of the pressure, the container is automatically returned to its sealed condition.

4 Claims, 8 Drawing Figures

CONTAINER-DISPENSER FOR DESICCANT MATERIAL FOR INCLUSION IN A RACKET HANDLE

The present invention relates to dispensers of drying material for inclusion in articles such as a tennis racket or the like.

When playing a game which utilizes a racket, such as tennis, squash, or the like, in which the racket is gripped by the player, the hand or hands holding the racket tend to perspire, particularly when the game is played on warm days. The resulting wetting of the racket hand causes the player to lose a secure grip on the racket, which often results in a marked loss by the player in racket control and playing effectiveness. During a halt in play, such as after the completion of a point or the end of a set, the player may dry off his hands by the use of a towel, or by rubbing the perspiring hand on his clothing.

However, such hand-drying procedures can only be resorted to during a stop of play so that during a rally, a tennis player is generally unable to remove the racket hand from the racket for a sufficient time to dry the hand holding the racket. Under these circumstances, the player must continue to play even though his control of the racket is no longer secure because of the accumulating perspiration on the racket hand.

The need for a means provided in a racket handle to enable a player to dry his racket hand is recognized, for example, in U.S. Pat. Nos. 1,563,852, 3,614,100 and 3,645,000, each of which discloses a dispenser of drying material contained in a racket handle. However, none of these dispenser constructions permit the player to effectively and reliably dry the racket hand without interrupting play, or to readily replenish the supply of drying material contained in the dispenser after the supply of material has been depleted.

It is thus an object of the invention to provide for use in a racket, a dispenser for drying material that permits the player to dry his racket hand without interrupting play.

It is a further object of the invention to provide for use in a racket, a container and dispenser of a drying material, which is sanitary and economical in use.

To these ends, the invention provides a sealed container and dispenser for insertion into a racket handle for containing and dispensing, when desired to dry the player's hand, a quantity of a desiccant material, such as rosin. The container is normally closed off by a two-piece closure which can be opened by the application of pressure by the palm of the user's hand to open the closure and release rosin. Upon the release of such pressure, the closure automatically closes.

To the accomplishment of the above and to such further objects as may hereinafter appear, the present invention relates to a container, substantially as defined in the appended claims and as described in the following detailed specification, considered with the accompanying drawings, in which:

Figure 1:
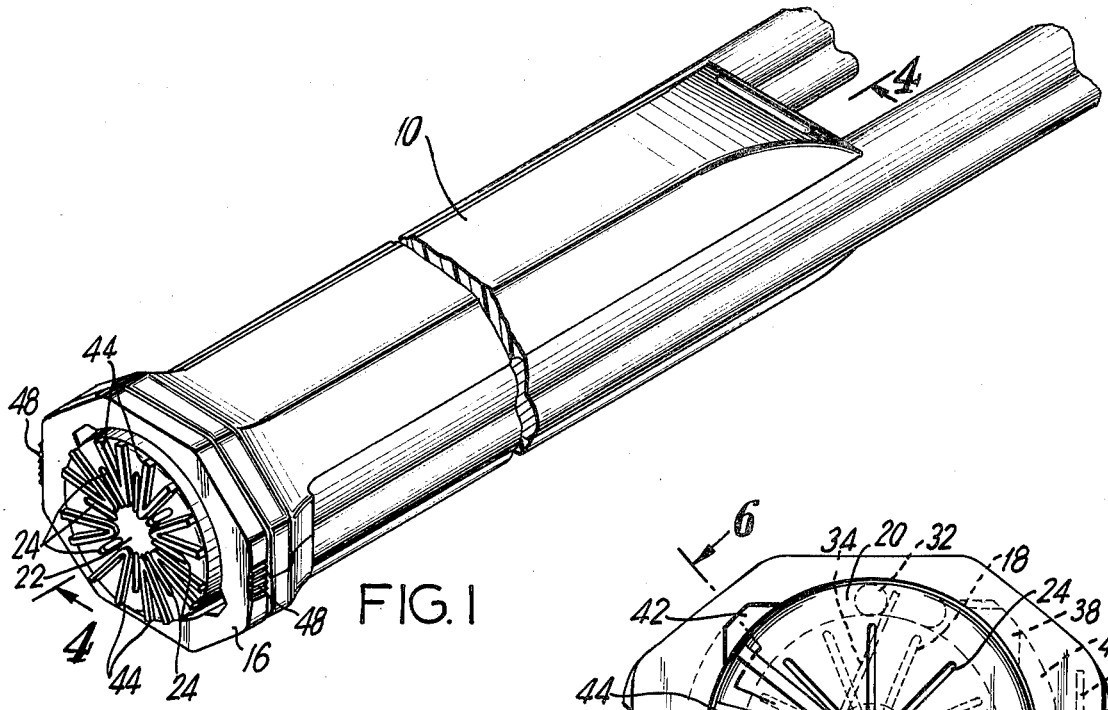
FIG. 1 is a perspective view of the lower end of a racket handle showing the container-dispenser of the invention.

The container-dispenser of the invention is disclosed in the figures as being inserted in the handle of a tennis racket or the like, which is generally designated 10. The container includes a cup 12 which is inserted into a recess formed in the lower end of the racket handle and stores a quantity of a desiccant material 14, such as rosin or a drying powder, which is capable of effectively absorbing perspiration when applied to the player's hand. The open end of the container is normally closed by a two-piece closure member, which may be operated by the player even during play to dispense a quantity of the desiccant material from the container when the player wishes to dry off his hand.

More specifically, the closure member includes an inner member 16 secured to and substantially co-extensive with the lower end of the racket, which has formed therein a number of radial slots or openings 18. The inner peripheral portion of the inner closure member is secured to the tip of the cup 12. The closure also includes a circular outer member 20 axially aligned with the inner closure member 16. Outer member 20 includes a central or hub portion 22 from which a series of slots or openings 24 project radially. Hub portion 22 has a narrow diameter pin 26 extending axially therefrom and passing through a central opening in the inner closure member 16. A disc or washer 28 is fixed to the end of pin 26 such as by a rivet 30.

Figure 4:
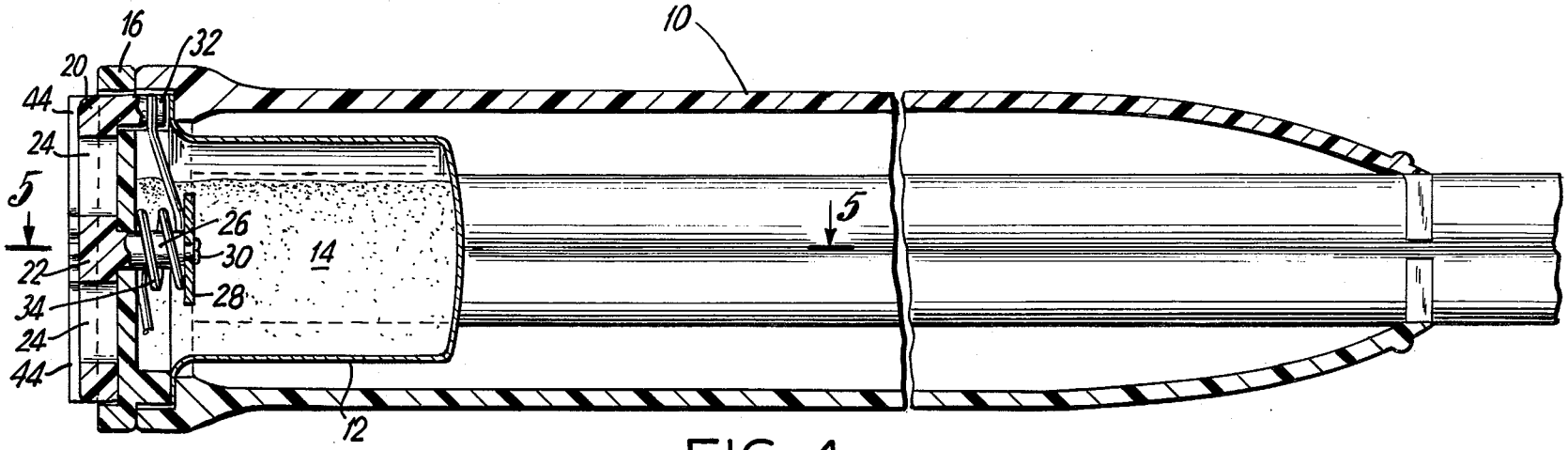
FIG. 4 is a cross-sectional view taken across line 4—4 of FIG. 1, illustrating additional features of the container-dispenser of the invention.
Figure 6:
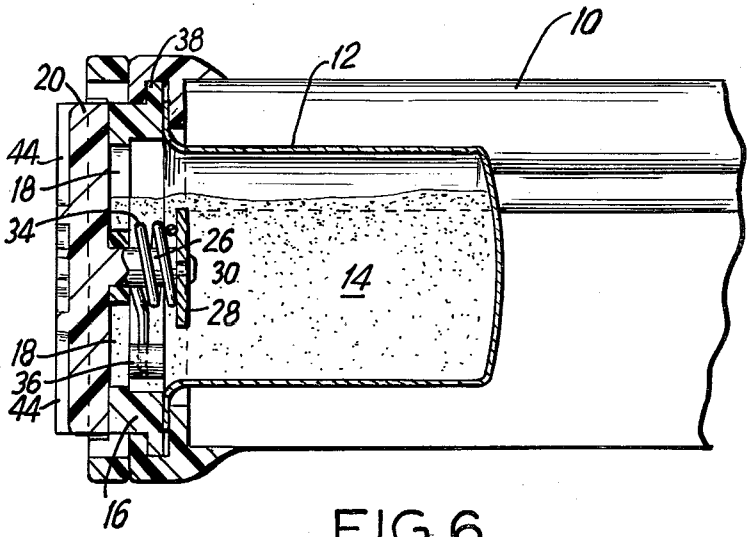
FIG. 6 is a cross-sectional view taken across line 6—6 of FIG. 2.
Figure 5:
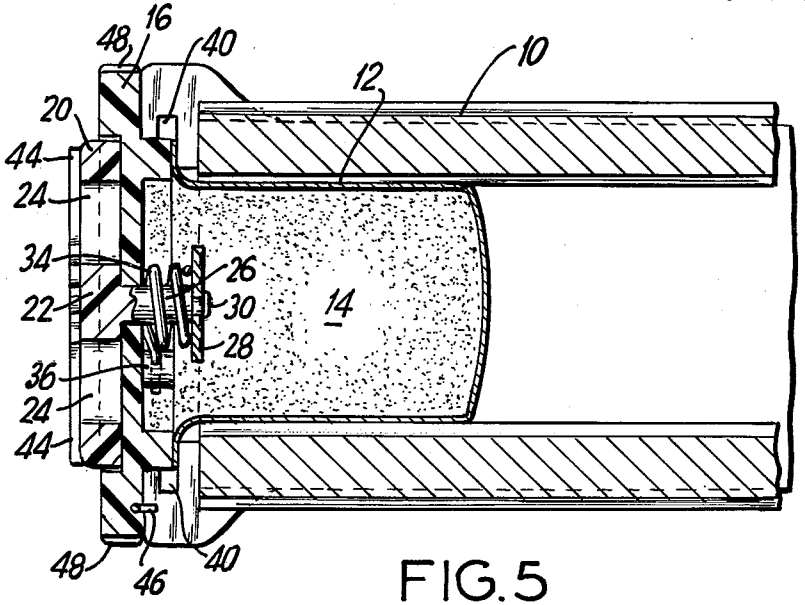
FIG. 5 is a cross-sectional view taken across line 5—5 of FIG. 4.

Closure member 20 also includes a pin 32 (FIG. 4) which is radially spaced from hub portion 22 and also extends through inner closure member 16. A spring 34 has two turns wrapped about pin 26 and has one end abutting against pin 32 and a second end abutting against a pin 36 extending from the inner closure member.

Figure 8:
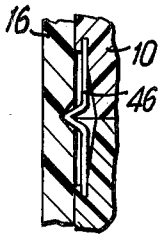
FIG. 8 is a fragmentary cross-sectional view taken across line 8—8 of FIG. 3.

The inner closure member also includes a pair of diametral tabs 38 which fit into and are free to move respectively within a pair of arcuate grooves 40 formed in the racket handle. Grooves 40 terminate in a pair of diametral openings 42. The outer closure member may include, as shown, a plurality of V-shaped ribs 44 or barriers provided between adjacent slots 24. A spring 46 (FIG. 8) is provided between the racket handle 10 and the inner closure member 16, to retain the latter to the end of the racket handle.

Figure 2:
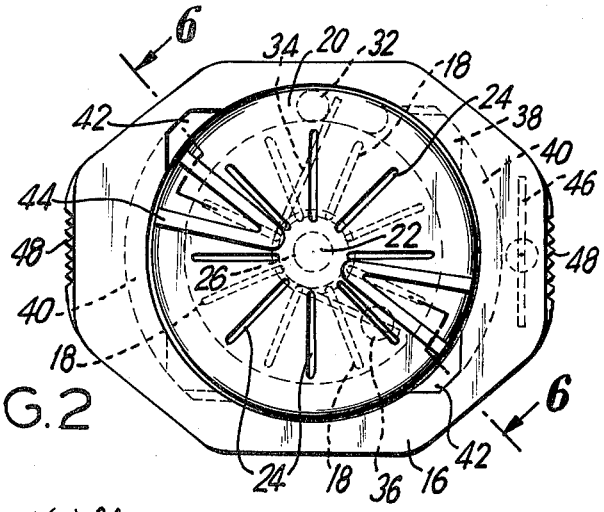
FIG. 2 is an end view of the racket handle showing the container-dispenser in the closed or nondispensing position.
Figure 3:
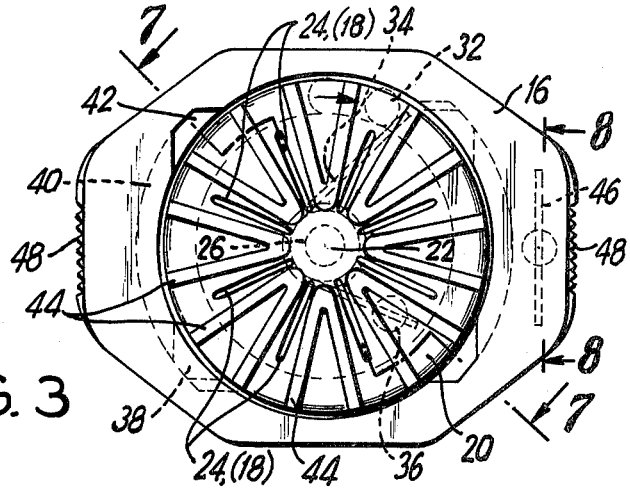
FIG. 3, is an end view similar to FIG. 2 but showing the container-dispenser in a material-dispensing position.
Figure 7:
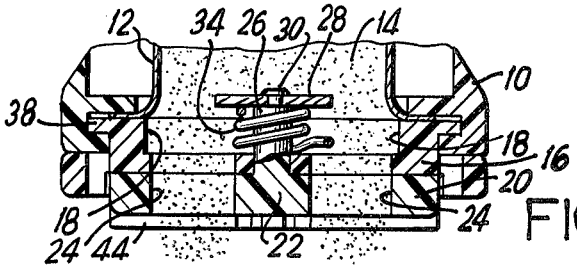
FIG. 7 is a cross-sectional view taken across line 7—7 of FIG. 3.

In use, the spring 34 acting on the outer closure member normally biases the latter into the position shown in FIG. 2, in which the outer slots 24 are not in alignment with the inner slits 18, such that no material 14 is able to fall through the slots. When the player wishes to dispense a quantity of the desiccant material onto his hands to dry off perspiration that has collected during play, he twists the outer closure member with his free hand against the opposing force of the spring until the upper closure member is in the position shown in FIGS. 3 and 7, in which the inner slots 18 and the outer slots 24 are in registration so that, as shown in FIG. 7, a quantity of desiccant material can flow out of the container and onto the player's hand. The ribs 44 prevent perspiration from the player's hand from passing through the aligned slots into the interior of the container. When the player releases the twisting pressure on the outer closure member, the spring acting thereon urges the outer closure member back to its rest position at which the openings 18 and 24 are not in alignment, so that the closure is again sealed and no material can pass out of the container.

Whenever the contents of the container are exhausted, the container may be removed by pivoting the inner member by grasping it at serrated portions 48, until tabs 38 are in registration with openings 42, thereby to permit the container and closure assembly to be removed from the racket handle and a new container filled with a new supply of desiccant material can be replaced into the racket handle. In an alternate construction, only the two-piece closure member may be removable and the remainder of the container retained within the racket handle may be refilled with desiccant material after which the closure may be replaced in position over the container.

Thus, whereas the container of the invention has been herein specifically described with respect to a single embodiment, it will be apparent that variations may be made therein without necessarily departing from the spirit and scope of the invention.

What is claimed is:

1. A dispenser for accommodation within the handle portion of an article such as a racket, or the like, said dispenser being adapted to receive a quantity of drying material and including a cup-shaped container open at one end, a two-piece closure member for sealing off said open end of said container, said closure member comprising a first member having a first plurality of radial slots formed therein, a second closure member axially aligned with said first closure member and having a second plurality of radial slots formed therein and a plurality of ribs arranged intermediate said second plurality of slots, and means in engagement with at least one of said first and second closure members to bias said one of said closure members to a first position with respect to the other of said closure members such that said first and second plurality of slots are not in registration, said second closure member being manually twistable against the opposition of said biasing means to a second position at which said first and second plurality of slots are in registration with one another to allow material to escape therethrough, said biasing means being effective to return said second closure member to its said first position upon the release of manual force from said second closure member.

2. The dispenser of claim 1, in which said second closure member includes a first central pin extending through said first closure member, and a second pin radially spaced from said central pin, said biasing means including a spring disposed about said central pin and having a free end abutting against said second pin.

3. The dispenser of claim 1, further comprising means for removably retaining said container to the open end of the racket handle.

4. The dispenser of claim 3, in which said retaining means includes a pair of diametral tabs extending from one of said closure members and received in a pair of grooves formed in the racket handle, said grooves each terminating in a passageway, and means permitting the rotation of said one of said closure members to bring said tabs into registration with said passageways, thereby to allow said closure members and said container to be axially removed from the racket handle by passing said tabs through said passageways.

* * * * *